United States Patent [19]

Lisiecki

[11] 4,397,415

[45] Aug. 9, 1983

[54] CONTAINER AND BLANK FOR CONSTRUCTING SAME

[75] Inventor: Robert E. Lisiecki, Orchard Lake, Mich.

[73] Assignee: Ex-Cell-O Corporation, Troy, Mich.

[21] Appl. No.: 352,403

[22] Filed: Feb. 25, 1982

[51] Int. Cl.[3] ..... B65D 5/72

[52] U.S. Cl. ..... 229/17 R; 229/44 R; 229/37 R; 206/628

[58] Field of Search ..... 229/44 R, 17 R, 7 R, 229/37 R, 37 E; 206/620, 628, 630

[56] References Cited

U.S. PATENT DOCUMENTS

| | | | |
|---|---|---|---|
| 2,603,403 | 7/1952 | Thompson | 229/37 E |
| 2,758,775 | 8/1956 | Moore | 206/628 |
| 2,866,586 | 12/1958 | Moore | 229/17 R |
| 2,926,832 | 3/1960 | Negoro | 229/7 R |
| 3,128,032 | 4/1964 | Hill | 229/17 R |
| 3,191,848 | 6/1965 | Meyers | 229/44 R |
| 3,893,614 | 7/1975 | Meyers | 206/628 |

*Primary Examiner*—Herbert F. Ross

*Attorney, Agent, or Firm*—John P. Moran

[57] ABSTRACT

The drawings and description disclose a thermoplastic coated square or rectangular container suitable for being filled with a juice concentrate which is frozen after filling, and having a top closure arrangement adapted to being readily fully opened to permit the frozen juice to be discharged through the top opening thereof. The top closure arrangement includes narrow edge panels on three sides thereof, with the front edge panel being folded back onto itself around a weakened or perforated line and having a lift tab extending therefrom, and a cover panel secured to the three edge panels such that the cover panel is peeled away from the three edge panels by manually lifting the lift tab and breaking the weakened line.

8 Claims, 4 Drawing Figures

CONTAINER AND BLANK FOR CONSTRUCTING SAME

This invention relates generally to thermoplastic coated paperboard containers and, more particularly, to a blank and a container including a top end closure of an improved construction.

BACKGROUND ART

Containers for beverages such as milk, cream, other dairy products, juices, and the like, are conventionally constructed from thermoplastic coated paperboard. Typically, these containers include a top end closure with a folded gable roof having a vertically projecting seal at the roof ridge for sealing the container and providing a readily available pouring spout when the contents of the container are to be dispensed.

Coated paperboard blanks for constructing such a container are made on converting machines similar to those disclosed by Monroe et al. U.S. Pat. No. 2,682,208 and Earp U.S. Pat. No. 3,731,600. After construction, the blanks are processed by forming, filling and sealing machines, such as those disclosed by Monroe et al. U.S. Pat. No. 3,303,761, Allen U.S. Pat. No. 3,918,236, Egleston U.S. Pat. No. 3,398,659 or Young U.S. Pat. No. 4,193,833, to produce the formed, filled and sealed containers of the type referred to above and shown and described in Egleston et al. U.S. Pat. Nos. 3,270,940 and 3,120,335.

While this type of container has been generally satisfactory for liquid products, it is desirable to utilize a similar square or rectangular thermoplastic coated paperboard container for frozen juices with a modified top closure arrangement, in lieu of using a conventional cylindrical paperboard container with a removable metal or solid plastic top cover.

DISCLOSURE OF INVENTION

Accordingly, a general object of the invention is to provide a blank for a frozen juice container including improved top closure means for attaining the above mentioned desirable arrangement.

Another object of the invention is to provide an improved thermoplastic coated paperboard container suitable for being filled with a juice concentrate and then frozen.

A further object of the invention is to provide a square or rectangular paperboard container including an improved flat top closure arrangement.

A still further object of the invention is to provide a flat top container having two short side edge panels, a front edge panel which is adaptable to being sealed at the ends thereof to the side edge panels, with an extention thereof being folded back across itself such that a lift tab extends beyond the front body panel, and a cover panel integrally connected to the top of the back body panel and adapted to fold across the entire top of the container and be sealed to the side and front edge panels.

Other objects and advantages of the invention will become more apparent when reference is made to the following description and accompanying drawings.

BEST MODE OF CARRYING OUT THE INVENTION

Figure 1:
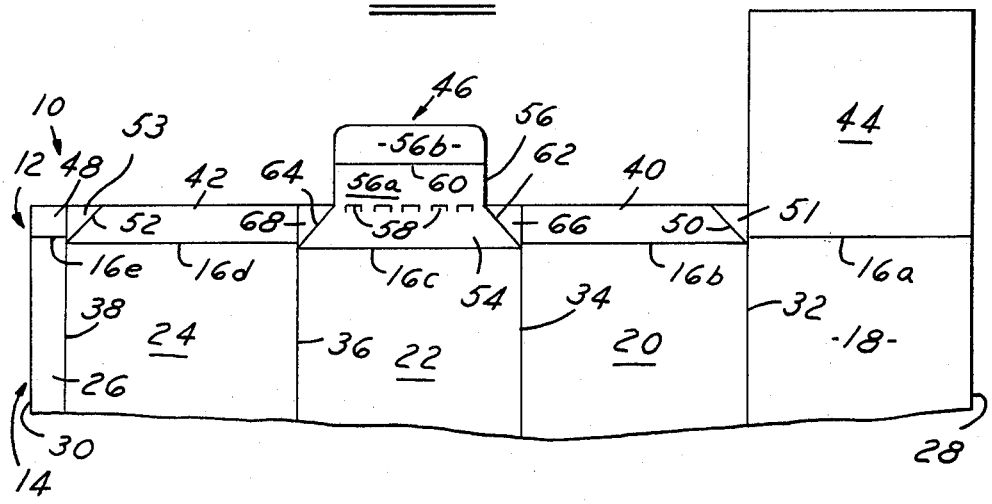
FIG. 1 is a fragmentary layout view of the inside surface of a coated paperboard container blank used to construct a container having a top end closure in accordance with the present invention.

Referring now to the drawings in greater detail, FIG. 1 illustrates a container blank 10 formed in accordance with the principles of the present invention. The container blank 10 is generally divided into three sections including a top end closure 12, a body portion 14, and a flat bottom end closure (not shown). The latter may be any suitable end closure arrangement and is not a part of this invention.

More specifically, staggered top horizontal score lines **16*a*, 16*b*, 16*c*, 16*d* and 16*e* extend transversely across the container blank 10 and separate the top end closure 12 and the body portion 14. As shown in FIG. 1, score lines 16*a* and 16*e* are at the highest elevation, score lines 16*b* and 16*d* are located below the score lines 16*a* and 16*e* a distance substantially equal to the thickness of the paperboard, and the score line 16*c* is the same distance below the score lines 16*b* and 16*d*. A staggered bottom horizontal score line (not shown) extends transversely across the container blank 10 and separates the bottom end closure (not shown) and the body portion 14. The body portion 14 comprises a plurality of integrally connected body panels, namely, a back panel 18, a side panel 20, a front panel 22 and a side panel 24, and a side seam flap or narrow fifth panel 26 formed adjacent the panel 24. The container blank 10 is defined on its longitudinal sides by its edges 28 and 30. The body panels 18, 20, 22 and 24, and the side seam flap 26, are defined by vertical score lines 32, 34, 36 and 38**. It should be apparent that the body panels may be equal in width and hence, adaptable to forming a square cross-section container, or may be formed such that one pair of alternate body panels is wider than the other pair and, hence, adaptable to forming a rectangular cross-section container.

The top end closure 12 comprises side fold-in edge panels 40 and 42. The panels 40 and 42 are connected integrally to the upper ends of the body panel members 20 and 24, respectively. A cover panel 44 and a front edge panel 46 are connected integrally to the body panels 18 and 22, respectively. A further panel 48 is connected integrally to the upper end of the side seam flap 26. A diagonal score line 50 extends from the approximate juncture of the score lines **16*b* and 32 to the free cut edge of the panel 40, forming a triangular fold-over panel segment 51. A diagonal score line 52 extends from the approximate juncture of the score lines 16*d* and 38 to the free cut edge of the panel 42, forming a triangular fold-over panel segment 53**.

Alternately, for improved carton top configuration, it may be desirable to move the point of intersection of the diagonal score lines 50 and 52 from the junctures of the vertical and horizontal score lines **16*b* and 16*d* apart from the vertical score lines 32 and 36, causing the panel segments 51 and 53** to be substantially trapezoidal in shape.

The front edge panel 46 includes a fold-in segment 54 connected to the body panel 22 and a narrower segment 56 extending from the panel segment 54, with a weakened line 58, such as a perforated line or a partial cut, formed therebetween. A horizontal score line 60 is formed across the panel segment 56 at a distance from the perforations 58 approximately equal to the height of the panel segment 54, separating the segment 56 into a fold-out portion 56*a* and a fold-down portion 56*b*, the latter to become a lift tab, as will be explained. Oppositely disposed diagonal score lines 62 and 64 are formed on the panel segment 54. The diagonal score line 62 extends from the juncture of the score lines 16*c* and 34 to the right hand (FIG. 1) juncture of the free cut edges of the panel segment 54 and the portion 56*a*, producing a triangular fold-over panel portion 66. The diagonal score line 64 extends from the juncture of the score lines 16*c* and 36 to the left hand juncture of the free cut edges of the panel segment 54 and the portion 56*a*, producing a triangular fold-over panel portion 68.

As indicated above with respect to the diagonal score lines 50 and 52, the diagonal score lines 62 and 64 may be moved away from the respective junctures of the adjacent vertical and horizontal score lines to points on the horizontal score line 16*c* apart from the respective vertical score lines 34 and 36.

The container blank 10 illustrated in FIG. 1 is first formed into a side seam blank in the customary manner by rotating the body panel 24 and the side seam flap 26 as a unit about the vertical score line 36, and having the inside surfaces of the body panel 24 come into contact with the inside surface of the body panel 22, with the vertical score line 38 positioned next to the vertical score line 34, and with the inside surface of the side seam flap 26 contacting the inside surface of the body panel 20 adjacent the vertical score line 34. The body panel 18 is then rotated about the vertical score line 32 to bring its inside surface into contact with the inside surface of the body panel 20. The inside surface of the body panel 18 along the edge 28 comes into contact with the outside surface of the side seam flap 26, and the edge 28 is positioned parallel and aligned with the vertical score line 38. The various members of the top end closure 12 and the bottom end closure will make similar movements. The container blank 10 is then sealed where the inside area of the body panel 18 comes into contact with the outside surface of the side seam flap 26.

In the FIG. 1 structure, if desired, in the formation of the side seam blank the side seam panel 26 could be sealed to the outside surface of the adjacent back panel 18, rather than to the inner surface thereof as described above.

Inasmuch as the eventual top closure arrangement of the invention is a non-gable, flat top configuration, it has been proven to be more compatible with existing forming, filling and sealing machines to form the top closure first, in a manner heretofore used for a conventional bottom closure arrangement. Then, after filling the container through the open end, the panels associated therewith are closed and sealed in any suitable manner.

Accordingly, after the side seam blank is opened up into a squared condition, the various parts of the eventual top end closure 12 are folded on the various score lines in the following manner so as to form the top end structure. The front edge panel 46 is folded or bent inwardly on the score line 16*c* and outwardly about the weakened or perforated line 58, and then downwardly about the score line 60, resulting in the fold-out panel portion 56*a* engaging the fold-in panel segment 54, and the fold-down panel portion 56*b* engaging the upper end of the front body panel 22. Such action will have caused the panel segment to begin to bend along the diagonal score lines 62 and 64. The side edge panels 40 and 42 are next folded or bent inwardly toward each other, causing the panel portions 66 and 68 to be pressed downwardly into engagement with the panel segment 54, while bending along the respective diagonal score lines 50 and 52. Finally, the cover panel 44 is folded or bent inwardly and downwardly, causing the panel portions 51 and 53 to be pressed downwardly into engagement with the respective panels 40 and 42.

Figure 2:
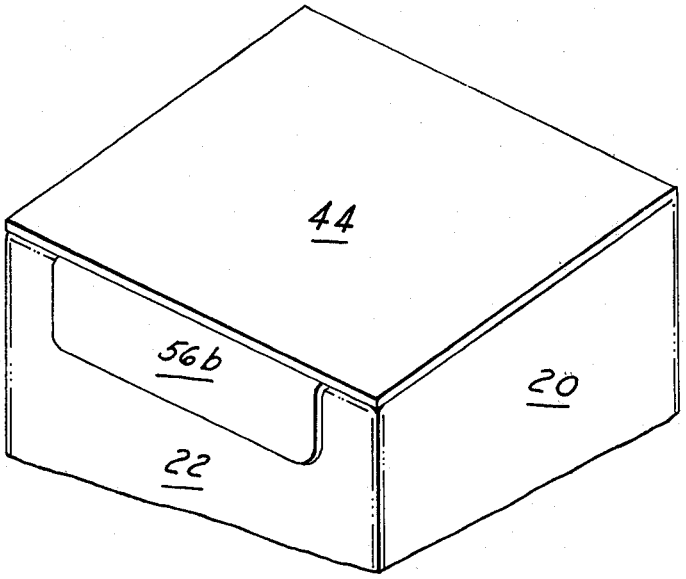
FIG. 2 is an enlarged fragmentary perspective view showing the container evolved from the blank of FIG. 1 in a closed condition.
Figure 3:
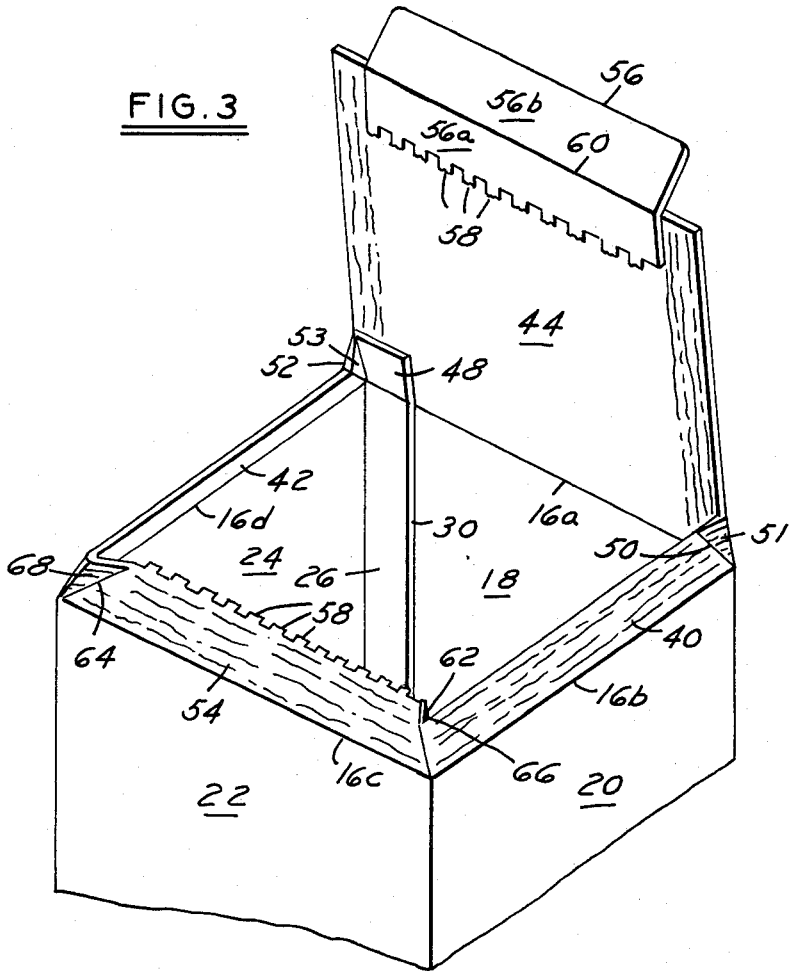
FIG. 3 is a fragmentary perspective view showing the container of FIG. 2 after the top closure has been sealed closed and then opened.

The sealing of the interrelated elements of the top closure 12 is then accomplished by conventional means, such as a sonic or high frequency vibration sealing means. The sealing of the various top end closure elements may also be accomplished by other means, such as gas heat, if desired. FIG. 2 illustrates the top end closure 12 structure once the sealing thereof has been effected. While the cover panel 44 is tightly sealed adjacent the upper ends of the body panels 20, 22 and 24 for a width equivalent to the heights of the panels 40, 42 and 54, the lift tab 56*b* may be merely spot welded to the front body panel 22 for eaay release therefrom.

In opening the carton, the lift tab formed by the panel portion 56*b* is lifted from the front body panel 22 and torn back, pulling the panel portion 56*a* away from the panel segment 54 and breaking the weakened line 58. As the lift tab 56*b* is raised further, the cover panel 44 is pulled away from the side edge panels 40 and 42. Simultaneously, the four fold-down panels 51, 53, 66 and 68 are partially peeled away from the panels 40, 42 and 54, thus providing a completely open top for discharge of frozen juice contents.

Figure 4:
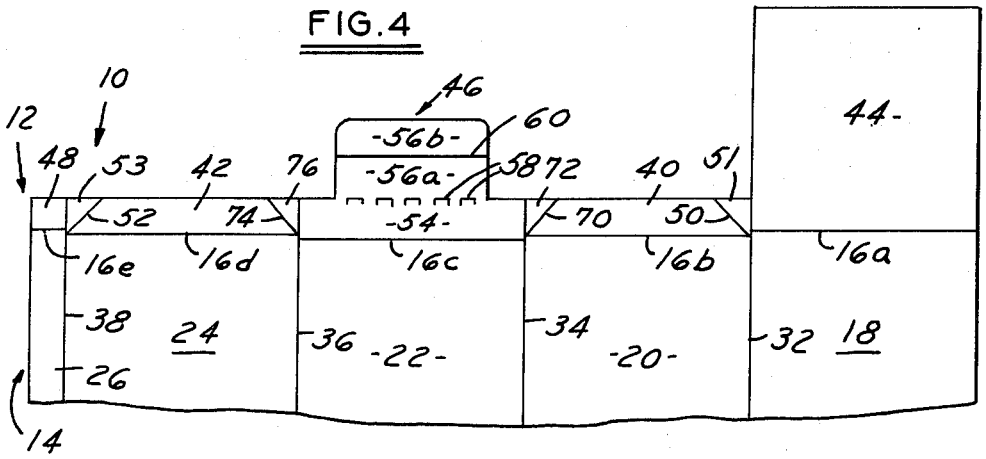
FIG. 4 is a fragmentary layout view of the inside surface of a modified form of blank from which a container embodying the invention may be erected.

Referring now to FIG. 4, there is illustrated an alternate blank embodiment, wherein all elements which are the same as those in the FIG. 1 embodiment bear the same reference numerals. However, a diagonal score line 70 is formed from the juncture of the score lines 16*b* and 34, or adjacent thereto on the score line 16*b*, to the free edge of the side fold-in edge panel 40, forming a substantially triangular fold-down panel 72 in conjunction with the panel 40, in lieu of the diagonal score line 62 and fold-down panel 66 in conjunction with the panel portion 54. Likewise, a diagonal score line 74 is formed from the juncture of the score lines 16*d* and 36, or adjacent thereto on the score line 16*d*, to the free edge of the side fold-in edge panel 42, forming a substantially triangular fold-down panel 76 in conjunction with the panel 42, in lieu of the diagonal score line 64 and fold-down panel 68 in conjunction with the panel portion 54. In the forming of this arrangement, the side edge panels would be folded or bent inwardly first, followed by the folding or bending of the panel portions 54, 56*a* and 56*b*. The fold-down panels 72 and 76 are thus pressed into engagement with and sealed to the panels 40 and 42, respectively, beneath the cover panel 44.

INDUSTRIAL APPLICABILITY

It should be apparent that the invention provides a novel and efficient thermoplastic coated paperboard carton which is ideally suited for being filled with a juice concentrate, such as orange juice concentrate, for example, and then adapted to being readily opened for removal of the contents after the orange juice concentrate has been frozen for distribution through the marketing system.

While two embodiments of the invention have been shown and described, other modifications thereof are possible.

The embodiments of the invention in which an exclusive property or privilege is claimed are defined as follows:

1. A thermoplastic coated blank for constructing a container, the blank comprising:

(a) body panels including front and back panels and a pair of side panels;

(b) a side fold-edge panel integrally connected to the top end of each of said pair of side panels;

(c) a front edge panel integrally connected to the top end of said front panel and including a fold-in segment and a fold-out segment, said fold-in and fold-out segments being interconnected by a weakened line, and a score line formed across the width of said fold-out segment at a distance away from said weakened line equal to the height of said fold-in panel segment;

(d) a cover panel integrally connected to said back panel;

(e) a diagonal score line formed on each of said side fold-in edge panels at the end thereof away from said front edge panel, said diagonal score lines converging in an upwardly direction;

(f) and an additional diagonal score line formed on one of said front fold-in panel segment or said adjacent side fold-in edge panels.

2. The blank described in claim 1, wherein each of said additional diagonal score lines is formed on said front fold-in panel segment, converging in an upwardly direction.

3. The blank described in claim 1, wherein one of said additional diagonal score lines is formed on each of said side fold-in edge panels diverging with respect to one another in an upwardly direction.

4. A thermoplastic coated container comprising:

(a) body panels including front and back panels and a pair of side panels;

(b) a side fold-in edge panel integrally connected by a first horizontal score line to the top end of each of said pair of side panels and folded on said first horizontal score line inwardly toward one another;

(c) a front edge panel integrally connected by a second horizontal score line to the top end of said front panel and including a fold-in segment, and a fold-out segment having a fold-out portion and a fold-down portion, said fold-in segment folded on said second horizontal score line;

(d) a weakened line interconnecting said fold-in and fold-out segments such that said fold-out segment is folded on said weakened score line onto and secured to said fold-in segment;

(e) a score line interconnecting said fold-out and fold-down portions such that said fold-down portion is folded on said score line onto and secured to the upper portion of said front body panel;

(f) a cover panel integrally connected by a third horizontal score line to said back body panel and folded on said third horizontal score line onto and secured to said side fold-in edge panels and to said fold-out panel portion;

(g) a diagonal score line formed on each of said side fold-in edge panels so as to form a corner segment on the end of each fold-in edge panel adjacent the end thereof away from said front edge panel, said corner segment being sealed to said side fold-in edge panel beneath said cover panel;

(h) an additional diagonal score line formed on one of said front fold-in panel or said respective side fold-in edge panels, providing corner segments thereon, said corner segments being sealed to one of said front fold-in panel and said respective side fold-in edge panels beneath said cover panel; and (i) said fold-down panel portion serving as a lift tab for manually opening said top closure by progressively lifting said tab away from said front body panel, lifting said cover panel away from said front fold-in panel segment, and thence away from said corner segments and said side fold-in edge panels, with the fold-out panel portion separating from the fold-in panel segment and breaking said weakened line to stay with said cover panel.

5. The container described in claim 4, wherein said additional diagonal score lines are formed on said front fold-in edge panel segment such that said corner segments are secured to said front fold-in edge panel segment beneath said cover panel.

6. The container described in claim 4, wherein said additional diagonal score lines are formed on said respective side fold-in edge panels such that said corner segments are secured to said respective side fold-in edge panels beneath said cover panel.

7. The container described in claim 4, wherein said corner segments are triangular in shape.

8. The container described in claim 4, wherein said corner segments are trapezoidal in shape.

* * * * *